United States Patent [19]

Imai et al.

[11] 4,166,789

[45] Sep. 4, 1979

[54] MAGNETIC SEPARATOR

[75] Inventors: Yukio Imai; Kunio Takeda; Jiro Terukina, all of Kobe, Japan

[73] Assignee: Kobe Steel, Ltd., Kobe, Japan

[21] Appl. No.: 910,430

[22] Filed: May 30, 1978

[30] Foreign Application Priority Data

| | | | |
|---|---|---|---|
| Aug. 27, 1977 | [JP] | Japan | 52-103048 |
| Aug. 27, 1977 | [JP] | Japan | 52-103049 |
| Sep. 2, 1977 | [JP] | Japan | 52-106078 |
| Sep. 7, 1977 | [JP] | Japan | 52-108284 |

[51] Int. Cl.[2] ..... B03C 1/12

[52] U.S. Cl. ..... 209/219

[58] Field of Search ..... 209/214, 223 A, 232, 209/219, 222; 210/222, 223

[56] References Cited

U.S. PATENT DOCUMENTS

| | | | |
|---|---|---|---|
| 2,437,681 | 3/1948 | Crockett et al. | 209/225 X |
| 2,868,377 | 1/1959 | Svirskis | 209/219 |
| 3,083,830 | 4/1963 | Broderick | 209/222 |
| 3,289,836 | 12/1966 | Weston | 209/222 X |
| 4,046,680 | 9/1977 | Fritz | 209/214 |
| 4,077,872 | 3/1978 | Glover et al. | 209/214 |

FOREIGN PATENT DOCUMENTS

| | | | |
|---|---|---|---|
| 1024901 | 2/1958 | Fed. Rep. of Germany | 209/214 |

*Primary Examiner*—Ralph J. Hill

*Attorney, Agent, or Firm*—Oblon, Fisher, Spivak, McClelland & Maier

[57] ABSTRACT

A magnetic separator comprising a feed hopper for a raw material to be separated, chutes for separating and discharging respectively the concentrate and the tailing magnetically separated from each other, a rotary drum incorporated in the casing and having separation walls of a non-magnetic material disposed on both sides thereof and forming therebetween at least one feed separation passageway extending from the feed hopper on the rotation side of the rotary drum up to the discharge shoots, and series of stationary magnetic poles disposed at the back of both of the separation walls.

10 Claims, 14 Drawing Figures

MAGNETIC SEPARATOR

BACKGROUND OF THE INVENTION (1) Field of the Invention

This invention relates to a magnetic separator for magnetically separating finely divided powder ores, etc. into magnetic components and non-magnetic components.

(2) Description of the Prior Art

There have conventionally been proposed a variety of apparatuses for magnetically separating ores into magnetic components and non-magnetic components using permanent magnets or magnetic poles consisting of electromagnets. However, these heretofore known apparatuses involve the drawback in their method of separating the ores in that they have a large and complicated construction and are not entirely satisfactory with respect to the separation accuracy and with regard to rate of production.

In carrying out the magnetic ore separation, the most critical problem is that when magnetic particles are magnetized by magnetic induction, the magnetic particles attract one another and entrap non-magnetic particles between them, thus prohibiting the perfect and satisfactory magnetic separation. This phenomenon is usually referred to as "entrapping" or "entraining" and is enhanced remarkably as the particles are smaller, thereby lowering the ore separation efficiency.

In order to solve this problem, the conventional apparatus includes separate devices as external means for floating the ore material to be separated by an air pressure, for forming a fluidized layer, for generating an air jet and the like in addition to the separation means using magnetic poles, for the purpose of dispersing and floating the ore simultaneously with, or during, the magnetic separation. However, when the ore for the separation is brought into the dispersed and floating state by such external means, the particles are, on the contrary scattered whereby the magnetic particles can hardly be collected onto the magnetic poles in an effective manner. In order to efficiently collect the dispersed and floating particles, therefore, it is necessary to use strong magnetic poles or a large and complicated mechanism for generating a strong magnetic force, which inevitably results in a drastic increase in the cost of installation and the running cost of the system.

Among the prior art references collected by the applicant of the present invention, U.S. Pat. No. 2,437,681 to R. E. Crockett, et al. discloses an apparatus for the magnetic separation of ores which recovers the concentrate (magnetic component) into an upper trough by the action of series of stationary magnetic poles aligned along one surface of an upwardly running conveyor belt while the feed material for the separation is being conveyed by the conveyor belt.

In U.S. Pat. No. 3,289,836 to D. Weston, the feed material for the magnetic separation moves along the feed pathway concurrently to the movement of moving magnets whereby only the concentrate is recovered in a concentrate chute together with the moving magnets and the tailing (non-magnetic component), which is not brought under the influence of the magnetic field, falls and is thus collected. In this patent too it is practically impossible to improve the ore separation efficiency unless a fluid is jetted into the apparatus so as to agitate slimes which tend to build up on the walls of the rotary drum.

The present invention contemplates providing a satisfactory solution to these drawbacks of the prior art.

SUMMARY OF THE INVENTION

It is therefore an object of the present invention to provide a magnetic separator which enables the efficient magnetic separation of powder raw ores by dispersing and floating the ores concurrently to the magnetic separation without resorting to any external means in particular to liberate the entraining phenomenon of non-magnetic particles.

The first embodiment of the present invention serves to accomplish the above and other objects thereof and includes a magnetic ore separation apparatus which comprises a feed hopper for a raw material to be separated, a discharge chute for the concentrate, a discharge chute for the tailing magnetically separated from the concentrate; a rotary drum incorporated in the casing, turnably pivoted and having separation walls of non-magnetic material formed on both sides of the drum and defining therebetween at least one feed separation passageway extending from the feed hopper on the side of the downward direction of rotation of the drum up to the discharge chutes; and a series of stationary magnetic poles disposed at the back of both of the separation walls.

In connection with the above-mentioned first embodiment, a second embodiment of the invention provides the magnetic ore separation apparatus wherein paddles are formed equidistantly and form a series of short, sharp angles, turns or alterations in a course or in a staggered, opposed arrangement or relationship on the separation walls on both sides of the feed separation passageway.

The third embodiment of the invention provides a magnetic ore separation apparatus wherein the stationary magnetic poles are disposed in the zigzag staggered opposed arrangement at the back of the separation walls forming the feed separation passageway.

The fourth embodiment of the invention provides a magnetic ore separation apparatus wherein a corrugated section is formed at least partially on the side surface of the feed separation passageway.

The fifth embodiment of the invention provides a magnetic ore separation apparatus wherein an expanded metal or metal net of a magnetic material is disposed at least partially on the wall surface of said feed separation passageway.

The sixth embodiment of the invention provides a magnetic ore separation apparatus wherein the series of stationary magnetic poles are formed zigzag in a staggered opposed arrangement at the back of both of the separation walls forming the feed separation passageway and an exhaust pipe line equipped with a dust collector with an exhaust blower being connected to the end portion of the discharge chute for the tailing.

The seventh embodiment of the invention provides a magnetic ore separation apparatus wherein the series of stationary magnetic poles are disposed zigzag in an staggered opposed arrangement at multi-stages in the axial direction and the series comprises magnets of a progressively higher magnetic force from the axis towards the outer circumference thereof.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF PREFERRED EMBODIMENTS

The apparatus of the present invention will be explained in further detail with reference to the accompanying drawings.

Figure 1:
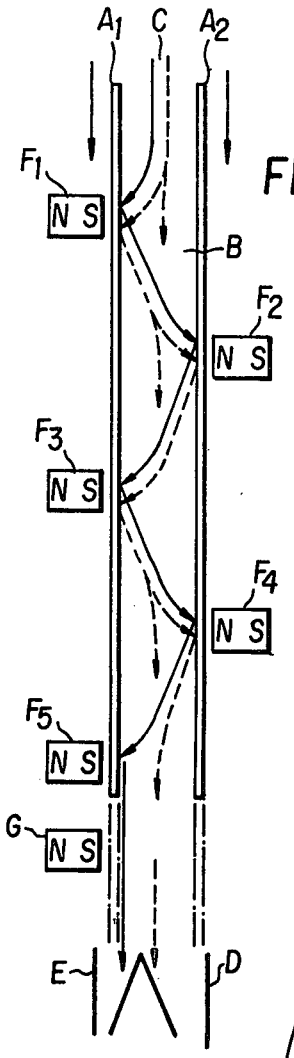
FIG. 1 is a schematic view showing the principle of the apparatus in accordance with the present invention.

In FIG. 1 which explains the principle of the present invention, there is shown diagrammatically an extremely simple construction of the present apparatus comprising separation walls $A_1$, $A_2$ enabling the rotation and movement of a non-magnetic material on both sides thereof and defining therebetween a passageway B of raw materials to be separated, a feed port C of the raw materials, discharging ports or tailing chutes D and E respectively for the concentrate and the tailing and a plurality of magnet pole pieces $F_1 \ldots F_5$ disposed in the staggered opposed arrangement in the proximity of, and along, the outer walls of the separation walls $A_1$, $A_2$.

The raw materials are fed from the feed port C at the upper portion and at the same time, the separation walls $A_1$, $A_2$ are rotated and moved in the direction indicated by arrows whereby a group of magnetic particles contained in the raw materials move along the side surface of the stationary pole pieces via the separation walls, and are conveyed while repeating attraction and jumping. Due to the jumping of the magnetic particles, the entrapping phenomenon of non-magnetic particles is temporarily liberated and the non-magnetic particles that have been enmeshed by the magnetic particles are removed therefrom, fall off and are finally discharged from the tailing chute D.

As the group of magnetic particles repeat jumping, the non-magnetic particles are sequentially removed therefrom and discharged from the tailing chute D. At the position of the final magnetic pole piece G, therefore, only the magnetic particles are attracted to and collected by the separation walls, enter the concentrate chute E therebelow and are thus collected.

After all the raw materials inside the passageway are subjected to the separation treatment in this manner, the empty endless passageway B moves upward and the raw materials are again fed at the upper position and caused to descend while being subjected to the separation treatment.

Each of preferred embodiments of the present invention will be made more apparent by referring to the accompanying FIGS. 2 through 8(*c*).

Figure 2:
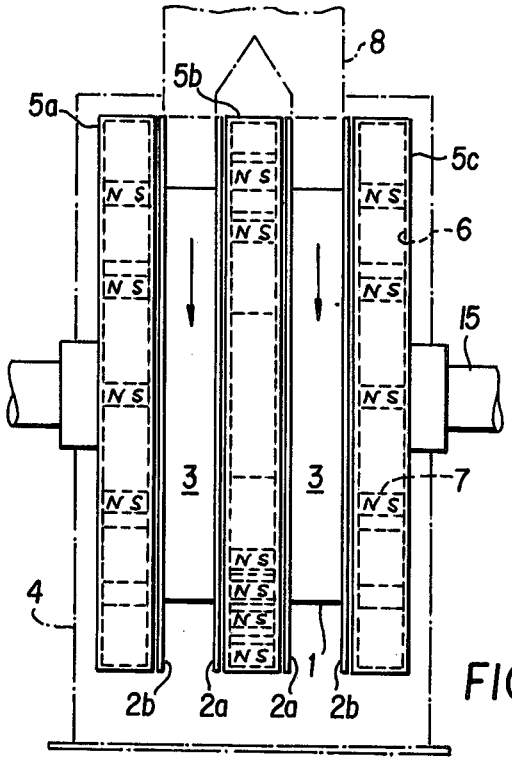
FIG. 2 is a front view showing the first embodiment of the apparatus of the invention.
Figure 3:
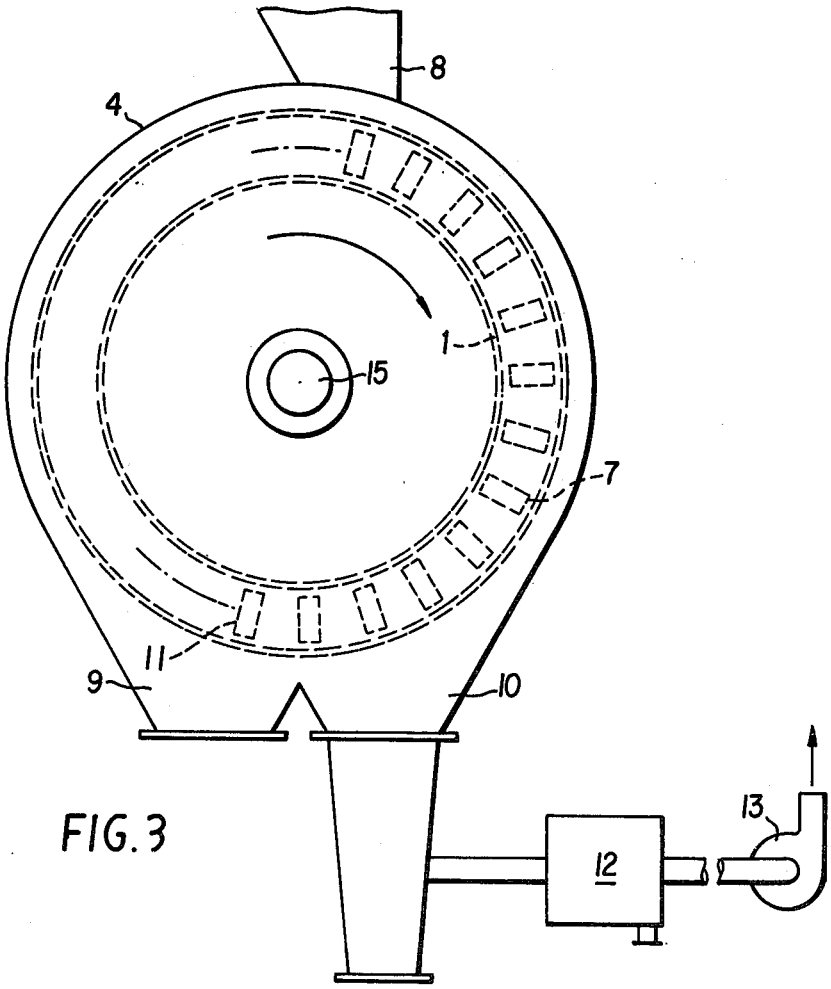
FIG. 3 is a side view of the apparatus of FIG. 2.

FIGS. 2 and 3 depict the first embodiment of the apparatus of the present invention wherein reference numeral 1 designates a rotary drum which is turnably and transversely mounted onto a driving shaft 15. Angular separation walls 2*a*, 2*b* of a non-magnetic material are protrusively formed around the circumferential surface of the rotary drum and define two stretches of raw material passageways 3, 3 between them.

The rotary durm 1 is incorporated in a casing 4 fitted coaxially with the drum. By this casing 4 is covered the outer circumferential side of the raw material passageways 3, 3, thereby defining perfectly closed tunnel passageways, and the rotary drum 1 is driven for rotation inside the casing 4. Reference numerals 5*a*, 5*b* and 5*c* respectively represent series of stationary magnetic pole pieces that are incorporated inside a sealed case 6 and aligned to extend from substantially the upper center of the inner circumference on one side down to the lower center of the casing 4. Between these three series of magnetic poles are disposed the abovementioned separation walls 2*a*, 2*b* to define the raw material passageways 3, 3. Hence, both sides of each raw material passageway is interposed by the opposing pole series and the separation wall is caused to rotate and move between these members.

Of the series of the magnetic poles 5*a*, 5*b* and 5*c* opposed to one another via the separation walls 2*a*, 2*b* on both sides of the feed passageways 3, 3, the poles 7 of the center series 5*b* are positioned so as to deviate by a half pitch from the poles of the right and left series, or, so as to correspond to the center between each pair of poles of the right and left series.

A raw material feed hopper 8 is adapted to be operatively associated with the upper portion of the casing 4 incorporating therein the rotary drum 1, and a concentrate discharging chute 9 and a tailing discharging chute 10 are respectively adapted to be operatively associated with the lower portion of the casing for the concentrate and the tailing separated by the magnetic separation.

In the magnetic ore separator apparatus of the embodiment having the above-described construction, the rotary drum 1 is first rotated at a predetermined speed in the direction indicated by the arrow, that is, in a clockwise direction, and the raw material to be separated is then fed from the hopper 8 at the upper portion of the casing whereby the raw material enters the right and left feed passageways 3, 3 from the bottom of the hopper, is guided by the drum 1 that is being rotated, and is conveyed from above to below. In this instance, non-magnetic particles are caused to naturally drop by the gravity and discharged from the tailing discharging chute 10 at the lowermost portion of the casing. Meanwhile, the magnetic particles are first attracted to the inner separation walls 2*a*, 2*a* at the position of the magnet 7 of the uppermost portion of the center pole series 5*b* which is most nearly adjacent the feed port. The magnetic particles attracted to the separation walls are conveyed while being attracted along with rotation of the drum 1 away from the magnetic field of the magnet 7, and then enter the magnetic field of the first magnets 7, 7 of the pole series 5a, 5c on the external side of the passageways. In this instance, the magnetic particles that have previously been attracted to the inner separation walls 2a, 2a jump over each passageway 3, 3 and are attracted to the outer separation walls 2b, 2b. Due to the jumping of the magnetic particles, the entrapping phenomenon of the non-magnetic particles is temporarily released and the non-magnetic particles are removed and fall off from the magnetic particles.

In this manner, rotation of the drum 1 causes the separation walls to move and whenever the magnetic particles (concentrate) sequentially and alternately repeat jumping between the feed passageways due to the series of the magnetic poles, the non-magnetic particles (tailing) is removed from the concentrate. Accordingly, by the time when the raw material moves downward to the position of the final magnet 7 at the lowermost position of the center pole series 5b, there is collected only the concentrate from which the tailing is perfectly separated.

The concentrate finally collected by the lowermost pole 7 is conveyed by a discharge guide pole 11 up to the upper portion of the concentrate chute 9 while it is being attracted to the separation walls 2a, 2a away from the magnetic field whereupon the concentrate falls down into the chute 9 and is discharged and collected. In the above-mentioned manner, the raw material fed from the hopper 8 at the upper portion of the casing is perfectly separated into the concentrate and the tailing at the lower portion of the casing.

Though the embodiment hereby described uses two strips of the feed passageways, more than two feed passageways may naturally be used whenever necessary.

In order to remove easily the tailing from the concentrate, to prevent the tailing once removed from the concentrate from being again entrapped by the concentrate during its jump by the subsequent poles and also to suppress the dust inside the apparatus, the ore separation efficiency of the present apparatus may be further enhanced by connecting a dust collector 12 and an exhaust blower 13 to the tailing discharging chute 13 as shown so as to generate a downward air stream.

Figure 4:
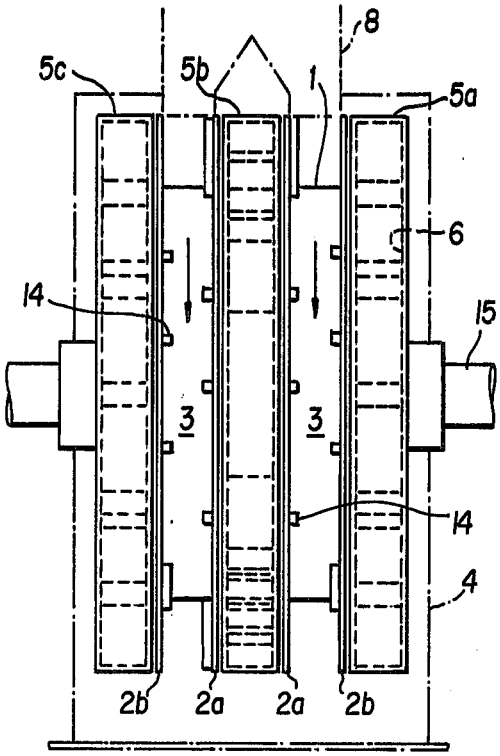
FIG. 4 is a front view showing another embodiment of the apparatus of the invention.
Figure 5A:
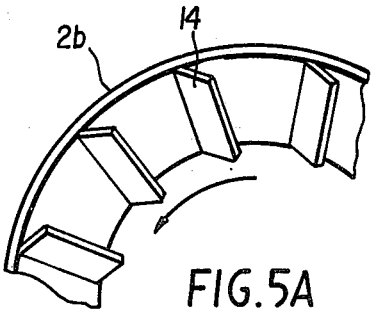
FIGS. 5(A), 5(B), 5(C) and 5(D) are perspective views of paddles of the apparatus of the invention.
Figure 5B:
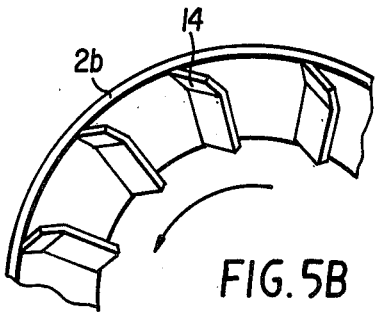
Figure 5C:
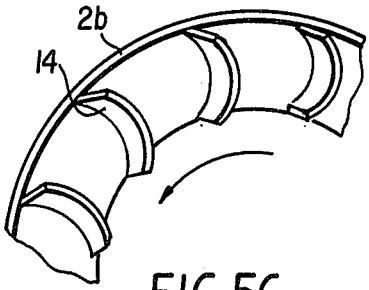
Figure 5D:
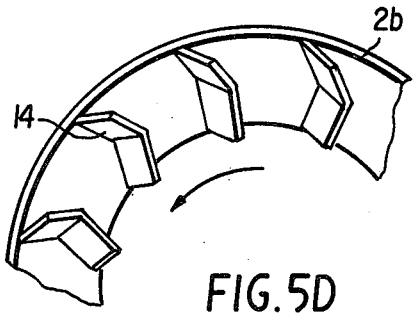

FIG. 4 shows another embodiment of the apparatus in accordance with the present invention wherein a plurality of paddles 14 are disposed equidistantly and in a staggered opposed arrangement on the separation walls 2a, 2b of the rotary drum 1 on both sides of each feed passageway 3 so as to prevent a slipping phenomenon of the concentrate and to ensure rapid and reliable attraction and separation.

FIG. 5(A), 5(B), 5(C) and 5(D) show various examples of the shape of the paddle 14.

Figure 6A:
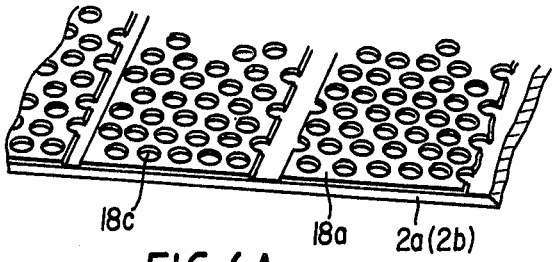
FIG. 6(A) is a perspective view showing an expanded metal member fitted to the separation wall of a rotary drum of the apparatus of the invention.
Figure 6B:
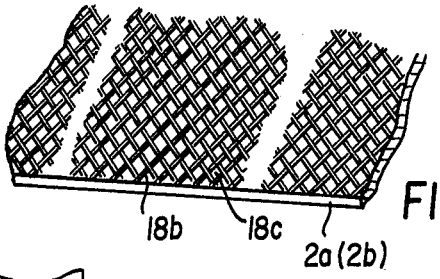
FIG. 6(B) is a perspective view showing a metal net fitted to the separation wall of the rotary drum of the apparatus of the invention.

According to another embodiment of the apparatus of the present invention, an expanded metal member 18a or a metal net 18b is partially or wholly fitted to the separation wall 2a(2b) of the rotary drum as shown repectively in FIGS. 6(A) and 6(B) in order to position the concentrate at 18c in the magnetic field, thereby utilizing the phenomenon that a high gradient magnetic field is generated in the space. This embodiment enables providing a magnetic ore separator which exhibits a high ore separation effect using economical magnets of a small magnetic force or electromagnets operative by a low electric current.

Figure 8A:
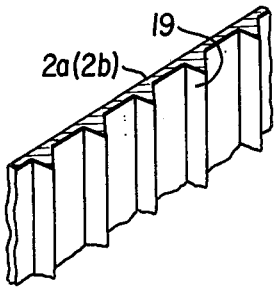
FIGS. 8(A), 8(B) and 8(C) are respectively perspective views showing corrugated sections to be formed on the separation wall of the rotary drum of the apparatus of the invention.
Figure 8B:
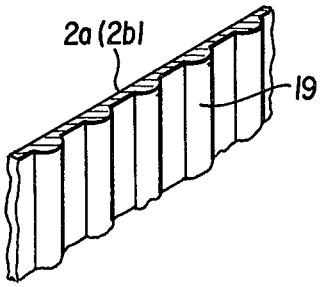
Figure 8C:
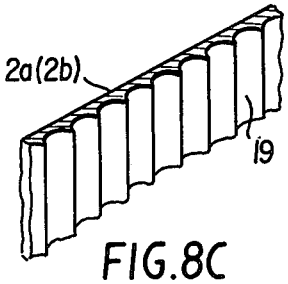

Next, as shown respectively in FIGS. 8(A), 8(B) and 8(C), corrugated sections 19 having a triangular sectional shape, a semicircular sectional shape or arcuate recesses are formed on the separation wall 2a(2b) of the rotary drum so that the raw material to be separated is agitated by these corrugated sections at the time of jumping of the concentrate. In an ore separator having the moving type separation paths, this arrangement enables easy release of the concentrate and the tailing from the separation walls and provides a higher level of the ore separation accuracy.

Figure 7:
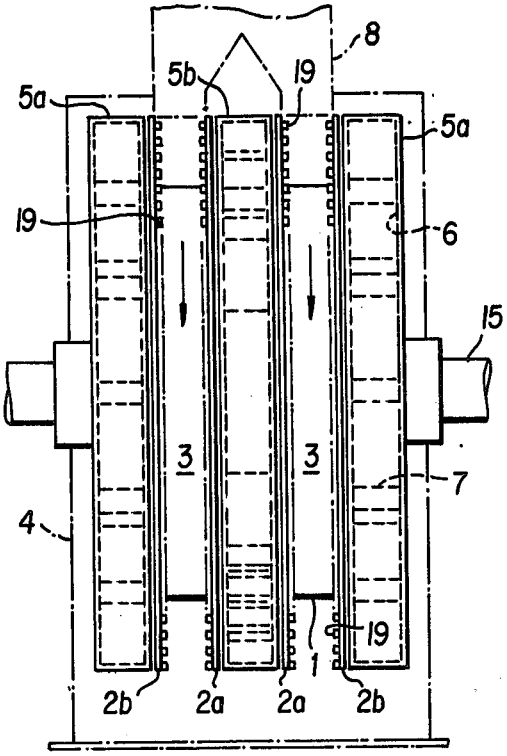
FIG. 7 is a front view showing still another embodiment of the apparatus of the invention.

FIG. 7 is a front view of an embodiment of the apparatus in accordance with the present invention having the abovementioned corrugated sections 19.

Though the embodiments described herein primarily deal with the dry type magnetic ore separation apparatus, the principle of the present invention may of course be adapted to a wet type magnetic ore separation apparatus.

Obviously, many modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A magnetic ore separation apparatus comprising:
a casing;
a feed hopper for a raw material to be separated connected to said casing;
a discharge chute connected at a lower portion of said casing for concentrate magnetically separated;
a discharge chute for tailing likewise magnetically separated connected to a lower portion of said casing adjacent said discharge chute for the concentrate magnetically separated;
a rotary drum incorporated in said casing, turnably pivoted and having at least first and second separation walls of non-magnetic material formed on the outside surface of said drum and defining therebetween at least one feed separation passageway extending from said feed hopper on the side of the direction of rotaton of said drum to said discharging chutes;
at least a first and a second series of radially extending stationary magnetic poles disposed at the back of both of said first and second separation walls; and
a plurality of cases within which each of said first and second series of stationary magnetic poles is disposed wherein each of said series of stationary magnetic poles extend along said feed separation passageway from the upper center circumference of said casing to the lower outer circumference of said casing.

2. The magnetic ore separation apparatus as defined in claim 1 which further comprises paddles formed equidistantly and in a staggered, opposed arrangement on said first and second separation walls on both sides of said feed separation passageway.

3. The magnetic ore separation apparatus as defined in claim 2 wherein the tip portion of each of said paddles with respect to the outer circumference of said rotary drum is bent.

4. The magnetic ore separation apparatus as defined in claim 3 wherein said stationary magnetic poles of said second series of stationary magnetic poles are disposed in a staggered, opposed arrangement at the back of said second and third separation walls with respect to said first and second series of stationary magnetic poles.

5. The magnetic ore separation apparatus as defined in claim 1 wherein said stationary magnetic poles are disposed in a staggered, opposed arrangement at the back of said first and second separation walls and said separation walls form said feed separation passageway.

6. The magnetic ore separation apparatus as defined in claim 1 which further comprises a corrugated section formed at least partially on the side surface of said feed separation passageway.

7. The magnetic ore separation apparatus as defined in claim 1 wherein an expanded metal member or metal net consisting of a magnetic material is disposed at least partially on the wall surface of said feed separation passageway.

8. The magnetic ore separation apparatus as defined in claim 1 wherein said series of stationary magnetic poles are disposed in a staggered, opposed arrangement at the back of both of said first and second separation walls forming said feed separation passageway and an exhaust pipe line equipped with a dust collector and an exhaust blower are connected to the end portion of said discharge chute for the tailing.

9. The magnetic ore separation apparatus as defined in claim 1 wherein said series of stationary magnetic poles are disposed in a staggered, opposed arrangement in an axial direction and said series comprise magnets of a progressively higher magnetic force from the axis towards the outer circumference thereof.

10. The magnetic ore separation apparatus as defined in claim 1 wherein said at least first and second separation wall comprises a first and second separation wall forming a first separation passageway of said at least one separation passageway and a third and fourth separation wall forming a second separation passageway of said at least one separation passageway and wherein said at least first and second series of stationary magnetic poles comprises a first, second, and third series of stationary magnetic poles such that said second series of stationary magnetic poles is disposed between said first and second passageways.

* * * * *